US009458005B2

(12) United States Patent
Horner

(10) Patent No.: US 9,458,005 B2
(45) Date of Patent: Oct. 4, 2016

(54) OVERFILL PREVENTION SYSTEM

(71) Applicant: Western Transportation, Inc., Decator, TX (US)

(72) Inventor: Daniel Horner, Paradise, TX (US)

(73) Assignee: Western Transportation, Inc., Decatur, TX (US)

( * ) Notice: Subject to any disclaimer, the term of this patent is extended or adjusted under 35 U.S.C. 154(b) by 231 days.

(21) Appl. No.: 13/948,730

(22) Filed: Jul. 23, 2013

(65) Prior Publication Data

US 2015/0027564 A1 Jan. 29, 2015

(51) Int. Cl.
*B67D 7/32* (2010.01)

(52) U.S. Cl.
CPC ..... *B67D 7/3218* (2013.01); *Y10T 137/7287* (2015.04); *Y10T 137/7306* (2015.04); *Y10T 137/7313* (2015.04)

(58) Field of Classification Search
CPC ..... B67D 7/3218; Y10T 137/7313
USPC ..... 137/392, 899, 345, 351, 347, 386; 141/95, 198
See application file for complete search history.

(56) References Cited

U.S. PATENT DOCUMENTS

| | | | | |
|---|---|---|---|---|
| 4,506,260 | A * | 3/1985 | Woodruff | H02H 11/001 340/649 |
| 5,007,450 | A | 4/1991 | Babb et al. | |
| 5,284,191 | A * | 2/1994 | McGarvey | 141/198 |
| 5,417,239 | A * | 5/1995 | Ford | 137/571 |
| 5,507,326 | A | 4/1996 | Cadman et al. | |
| 5,607,000 | A * | 3/1997 | Cripe et al. | 141/21 |
| 5,951,161 | A * | 9/1999 | Blagg | 366/152.6 |
| 5,975,162 | A | 11/1999 | Link, Jr. | |
| 6,082,392 | A * | 7/2000 | Watkins, Jr. | 137/312 |
| 6,343,896 | B1 | 2/2002 | Goodier et al. | |
| 7,597,215 | B2 * | 10/2009 | Sleiman | 222/65 |
| 2002/0188382 | A1 | 12/2002 | Sherwood | |
| 2004/0085200 | A1 * | 5/2004 | McConnel et al. | 340/450.2 |
| 2005/0065684 | A1 | 3/2005 | Larson et al. | |
| 2006/0225895 | A1 * | 10/2006 | Grant | A62C 35/58 169/16 |
| 2006/0231574 | A1 * | 10/2006 | Bilskie et al. | 222/129.1 |
| 2010/0089486 | A1 * | 4/2010 | Koeninger et al. | 141/2 |
| 2011/0120589 | A1 | 5/2011 | Evans | |
| 2012/0145251 | A1 * | 6/2012 | Robol | E04H 4/1245 137/14 |

* cited by examiner

*Primary Examiner* — Craig Schneider
*Assistant Examiner* — Josephine Trinidad-Borges
(74) *Attorney, Agent, or Firm* — Locke Lord LLP

(57) ABSTRACT

This invention relates to an overfill prevention system for preventing the overfilling of tanks when filling up large tanks from a fuel distribution truck. The system operates by monitoring and automatically controlling the filling process by use of a power take off switch assembly that is connected electronically to a secondary overfill prevention system that is also connected to a signal probe located in the tank that is being filled. In operation, once fuel contacts the signal probe, a communicator signal is sent from the signal probe to a secondary overfill prevention system, which interrupts a looping electrical current through a fuel shut off sensor assembly to a power take off switch assembly along a connecting cable. Once the looping electrical current no longer returns to the power take off switch assembly, an indicator light turns off and a pneumatic switch is flipped, which automatically stops the flow of air from the distribution truck's air tank to the power take off that drives a pump that is controlling the flow of fuel. This stops the flow of fuel to the tank and prevents costly, damaging and dangerous overfills.

5 Claims, 3 Drawing Sheets

OVERFILL PREVENTION SYSTEM

BACKGROUND OF THE INVENTION

1. Field of the Invention

This invention relates to an overfill prevention system that serves to monitor and control the fuel filling process to protect against overfilling of a tank, and more specifically to an overfill prevention system that comprises a fuel shut off sensor assembly connected electronically to a power take off switch assembly, which controls the fuel pump and stops the flow of gasoline or diesel from the fuel reservoir to the tank being filled.

2. Description of Related Art

Fuel distributors use large transport truck tractors, cargo tank trailers and bobtail tank trucks to provide fuel, oil or other fluids to heavy machinery in the field that is unable or impractical to fuel at a regular fill-up station. These large fuel transports can be used to transport fuel and oil over a large region to customers who use the fuel for various purposes including specifically to fuel frac equipment.

One concern fuel distributors face is the accidental overfilling that can occur as the fuel or oil is being pumped from a transport to the heavy machinery or frac equipment. Because of the nature of the fuel and oil being pumped, accidental overfills can create adverse health and environmental issues that must be addressed by the fuel distributor. As such, personal and environmental safety are top priorities of fuel distributors. Additionally, there are significant costs associated with overfilling including both the environmental cleanup costs as well as the cost of the wasted fuel or oil. These costs are also borne by the fuel distributor.

There are current systems in place that use fuel probes located within a fuel tank that are designed to sense the fuel level within the tank. These fuel probes are typically connected electronically to a secondary overfill prevention system, such as the IntelliCheck®2 System from the Scully Signal Company. Once the fuel probe in the tank senses that the fuel level has reached the preset level of capacity (typically when the fuel is within 60 gallons of maximum capacity), the secondary overfill prevention system indicates that the tank has reached this capacity. However, the secondary overfill prevention system does not have the ability to shut off the pump and stop the flow of fuel.

It is therefore desirable to have an overfill prevention system, which has a fuel shut off sensor assembly connected electronically to a switch assembly connected to the pump via a power take off switch assembly, which controls the flow of gasoline from the fuel reservoir to the tank being filled, thus preventing expensive and dangerous overfill situations.

SUMMARY OF THE INVENTION

The present invention provides generally for an overfill prevention system that serves to monitor and control the fuel filling process to protect against overfilling of a tank. The overfill prevention system uses a fuel shut off sensor assembly connected electronically to a power take off switch assembly, which controls the flow of fuel from the fuel reservoir to the tank being filled.

In a preferred embodiment, the overfill prevention system includes two components: a fuel shut off sensor assembly ("FSOSA") and a power take off switch assembly ("PTOSA"). The FSOSA is located on or near the tank that is being filled and is connected electronically to a secondary overfill prevention system, such as the IntelliCheck®2 System from the Scully Signal Company. The FSOSA comprises a bracket that is mountable to or near the tank and near the secondary overfill prevention system. The bracket includes a two-wire cable with a first end connected to the secondary overfill prevention system and a second end connected to the bracket. The first end is connected to the secondary overfill prevention system in such a way as to receive the signal from that system that the fuel in the tank has exceeded its safe fuel limits during the filling process. The second end of the cable is wired to a cable receptacle, which is connected to the bracket and protected by a hinged cover. Preferably the receptacle is a traditional four pin receptacle.

The PTOSA is located on the fuel distribution truck and is comprised of a housing with a cover, internal electronics including wiring and relays, and a switch. In a preferred embodiment, the cross section of the housing is preferably square in shape with four sides, a top and a bottom. Mounted externally to one of the sides of the housing are an air intake port, an air outlet port, and a cable receptacle with a hinged cover. Additionally, there is a two-wire power cable which protrudes through a side of the housing and is attached to an external power supply, preferably the battery on the fuel distribution truck. There is an indicator light and toggle switch mounted externally to the top of the housing, which is removable from the sides and bottom of the housing. Internally, the power supply cable is attached electronically first through the toggle switch and then to a relay. There is a pneumatic switch located in the housing, which is electronically connected to the relay and controls the flow of air between the air intake port and air outlet port. When the switch is open, air can flow from the air intake port to the air outlet port, but when the switch is closed, the flow of air is stopped. The external cable receptacle is also connected electronically to the toggle switch and relay. The indicator light is connected electronically to the relay.

In the preferred embodiment, the PTOSA is connected to the air tank on the distribution truck via the air inlet port and the PTOSA air outlet port is connected to the truck's power take off. When the power take off is receiving air, then the power take off powers the fuel pump and fuel is pumped from the distribution truck. In operation, the fuel distributor connects a two-wire cable between the FSOSA and PTOSA by plugging the cable in to the respective cable receptacles on the FSOSA and PTOSA. This two-wire cable is looped electronically through the secondary overfill prevention system and electrical current flows from the PTOSA down one wire to the secondary overfill prevention system and back to the PTOSA along the other wire. The toggle switch on the PTOSA is in the on position and the indicator light is on. The fuel flows from the fuel distribution truck into the tank until the fuel makes contact with the fuel probe in the tank.

Once fuel contacts the fuel probe, a communicator signal is sent to the secondary overfill prevention system. The secondary overfill prevention system closes a switch, which stops the looping flow of electricity through the two-wire cable between the secondary overfill prevention system and the FSOSA and then between the FSOSA and the PTOSA along the connecting cable. Once the electricity flow is stopped from the secondary overfill prevention system to the PTOSA, the indicator light turns off and the pneumatic switch is flipped automatically stopping the flow of air from the distribution truck's air tank to the power take off. This stops the flow of fuel to the tank and prevents costly, damaging and dangerous overfills. The operator can then flip the manual toggle switch to off and move on to the next fuel job. If the probe is set at a level that is above the desired level in the tank, then the operator must drain some fuel from the tank before moving on to the next fuel job.

In an alternative embodiment, the switch located in the housing of the PTOSA is an electrical switch, which is electronically connected to the relay and controls the flow of electricity directly to the pump. Rather than the PTOSA having an air intake and air outlet ports, the pump's electrical cable enters the PTOSA and is connected to the electrical switch. The operation of the PTOSA is the same as described above, and when fuel contacts the fuel probe, the switch flips and no electricity flows to power the electrical pump.

If at any time during the filling, the operator needs to stop the flow of fuel, he can flip the manual toggle switch from the on to off position. Also, a dummy plug is available to plug into the cable receptacle on the PTOSA, which completes the circuit and allows the manual operation of the system through the use of the toggle switch on the PTOSA. This is useful in situations where the fuel indicator probe is inoperable or if the distributor wishes to add more fuel than the preset tank limit.

The novel features and construction of the present invention, as well as additional objects thereof, will be understood more fully from the following description when read in connection with the accompanying drawings.

BRIEF DESCRIPTION OF THE DRAWINGS

The improved process of the invention is further described and explained in relation to the following figures of the drawings wherein.

Like reference numerals are used to describe like parts in all figures of the drawings.

DESCRIPTION OF THE PREFERRED EMBODIMENTS

Figure 1:
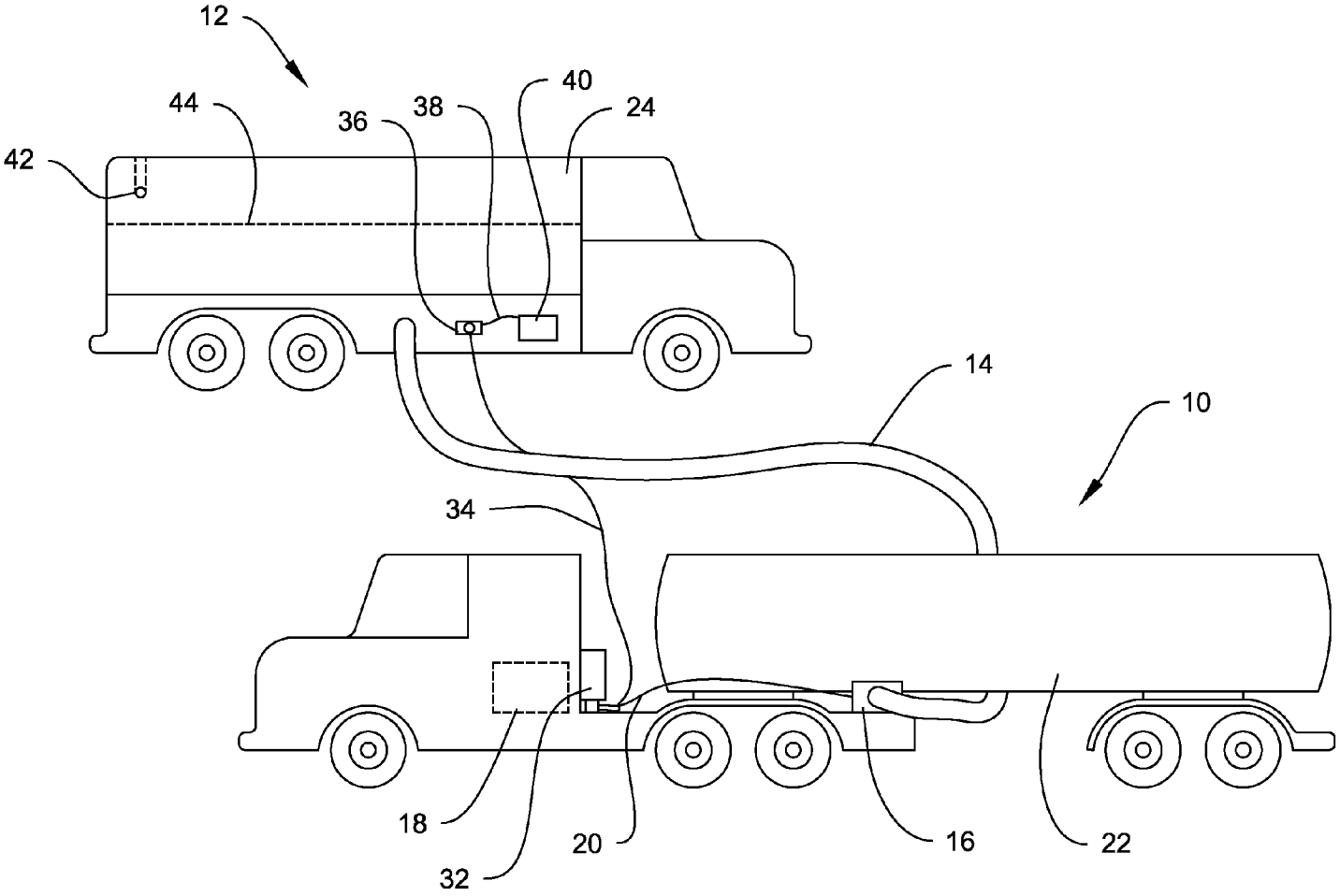
FIG. 1 is an illustration of a fuel tanker tractor trailer pumping fuel into the tank of a bobtail tanker truck.

Referring to FIG. 1, a fuel tanker tractor trailer 10 is shown pumping fuel into the tank of a bobtail tanker truck 12 utilizing the overfill prevention system of the present invention. Fuel from tank 22 of fuel tanker 10 is pumped by pump 16 through hose 14 to tank 24 of bobtail tanker 12. Bobtail tanker 12 is equipped with secondary overfill prevention system 40, which is connected electronically to fuel probe 42 located internally in tank 24. As bobtail tanker 12 is filled, fuel level 44 in tank 24 rises. Once fuel level 44 contacts fuel probe 42, a communicator signal is sent from fuel probe 42 to secondary overfill prevention system 40. One commercially available secondary overfill prevention system 40 is the IntelliCheck®2 System manufactured by the Scully Signal Company.

Fuel shut off sensor assembly ("FSOSA") 36 is mounted on bobtail tanker 12 near secondary overfill prevention system 40 and is in electronic connection with secondary overfill prevention system 40 via cable 38. Cable 38 is preferably a two-wire cable connected electronically to secondary overfill prevention system 40 in such a way that an electrical signal initially received from power take off switch assembly ("PTOSA") 32 is looped through FSOSA 36 to secondary overfill prevention system 40 and back to FSOSA 36 via cable 38. Once secondary overfill prevention system 40 receives the communicator signal from fuel probe 42, the looping electric signal is interrupted. FSOSA 36 is comprised of a bracket and a cable receptacle. Cable 34 is connected to FSOSA 36 and passes the looping electrical signal received from PTOSA 32 to FSOSA 36. PTOSA 32 is connected in pneumatic connection with air tank 18 of tanker truck 10 via air line 20, which is also connected to the power take off of tanker truck 10. Power take off of tanker truck 10 drives a shaft which in turn drives fuel pump 16. When the looping electrical signal is interrupted and no longer received back by PTOSA 32, PTOSA 32 shuts off air flow through air line 20, which in turn ultimately turns off fuel pump 16 and stops the flow of fuel from tank 22 of tanker truck 12 to tank 24 of bobtail tanker 12.

Figure 2:
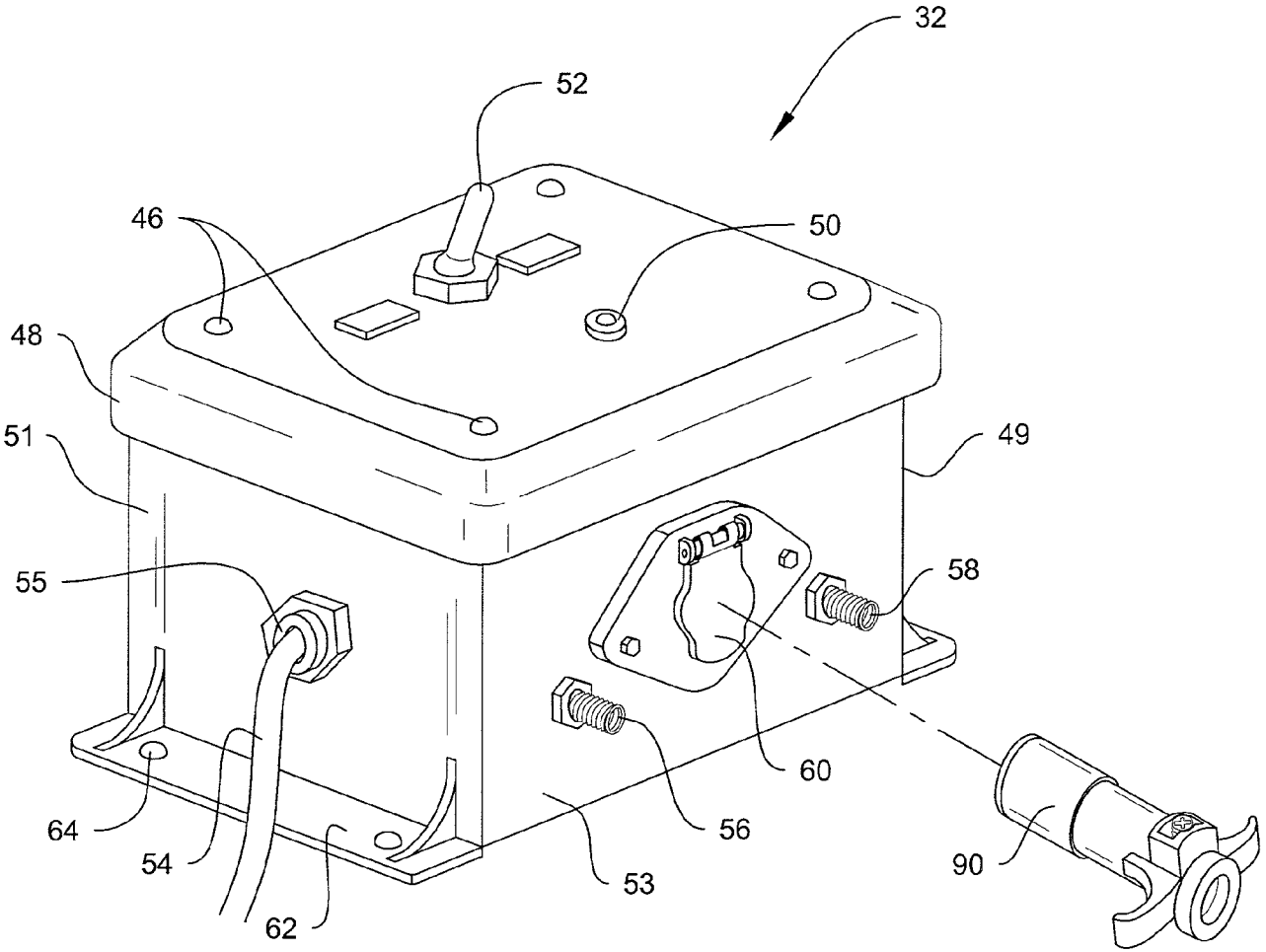
FIG. 2 is a perspective view of the novel power take off switch assembly.

Referring to FIG. 2, a perspective view of PTOSA 32 is shown. PTOSA 32 comprises housing 49 with removable cover 48. Removable cover 48 is secured to housing 49 with a plurality of bolts 46, although other securing means such as clips, straps or the like could be used to secure cover 48 to housing 49. Removable cover 48 has toggle switch 52 and indicator light 50 attached such that toggle switch 52 is operable and indicator light 50 is visible when removable cover 48 is attached to housing 49. In the preferred embodiment, housing 49 has a generally square cross-section with four sides (51 and 53 shown) and a bottom 62. Bottom 62 extends beyond two opposing sides (51 shown) to create a mounting flange, which allows PTOSA to be attached to fuel distribution vehicle 10 via bolts through bolt holes 64. One side 51 of housing 49 has power cable 54 protruding from hole 55. Power cable 54 is attached to a power supply such as the truck's battery. In the preferred embodiment, power cable 54 is a two-wire cable. Side 53 has air inlet port 56 and air outlet port 58 along with cable receptacle 60.

Figure 3:
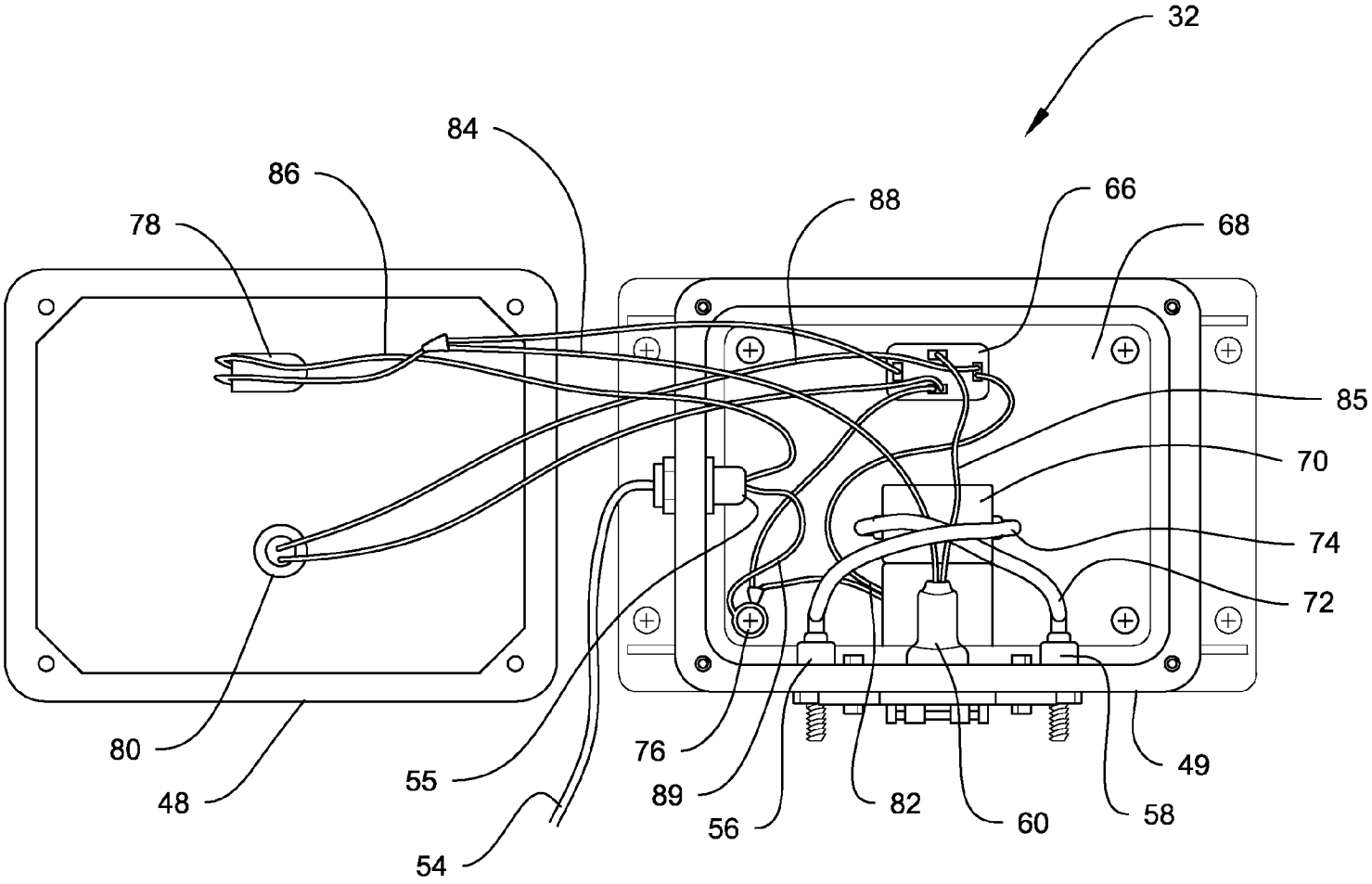
FIG. 3 is a top view of the power take off switch assembly with the removable cover removed and laying to the left side.

Referring to FIG. 3, a top view of PTOSA 32 is shown with cover 48 removed and laying upside down to the left side of housing 49 exposing the inner wiring and switches of PTOSA 32. Hot wire 86 and neutral wire 89 of power cable 54 (not shown) enter housing 49 through hole 55. Neutral wire 89 is connected to grounding screw 76, which is attached to mounting plate 68 located in the bottom of housing 49. Hot wire 86 is connected to the backside 78 of toggle switch 52. The looping electrical signal leaves and returns to PTOSA 32 via cable receptacle 60. Hot wire 84 from communicator signal is connected to toggle switch 78, while neutral wire 85 is connected to relay 66. Backside 80 of indicator light 50 is connected via wire 88 to relay 66. Pneumatic switch 70 is connected to relay 66 via wire 82. Connector air hose 74 connects air inlet port 56 to pneumatic switch 70, and likewise connector air hose 72 connects air outlet port 58 to pneumatic switch 70. Both relay 66 and pneumatic switch 70 are grounded to grounding screw 76.

In operation, the operator connects fuel hose 14 from tanker truck 10 to bobtail tanker 12 as well as connecting FSOSA 36 to cable receptacle 60 on PTOSA 32 with cable 34. The operator flips toggle switch 52 to the on position, which opens pneumatic switch 70 and illuminates indicator light 50. Air tank 18 provides air via air line 20 to the power take off of pump 16, which begins the flow of fuel from tanker 10 to bobtail 12. Once tank level 44 contacts signal probe 42, a communicator signal is to secondary overfill prevention system 40. Once the communicator signal is received by secondary overfill prevention system 40, the looping electrical signal is interrupted and no electrical signal passes back along cable 38 to FSOSA 36 and then along cable 34 to PTOSA 32. Once PTOSA 32 receives no electrical signal via receptacle 60, indicator light 50 turns off and pneumatic switch 70 closes. This automatically stops the flow of air from air tank 18 to the power take off on tanker truck 10 which ultimately stops the flow of fuel between tank 10 and bobtail 12 by no longer powering fuel pump 16.

If at any time during the filling, the operator desires to stop the flow of fuel from tanker 10 to bobtail 12, he can flip toggle switch 52 from the on to off position. Flipping toggle switch 52 causes pneumatic switch 70 to close, which automatically stops the flow of air and stops fuel pump 16. To resume the flow of fuel, the operator would simply flip toggle switch 52 back to the on position. In situations where signal probe 42 or secondary overfill protection system 40 is inoperable, a dummy plug is available to plug into cable receptacle 60 on PTOSA 32. The dummy plug completes the circuit (e.g., makes a looping electrical signal) and allows the manual operation of the system wherein the operator controls the flow of fuel solely by use of toggle switch 52. The dummy plug is also useful when the distributor wishes to raise fuel level 44 of tank 24 on bobtail 12 past signal probe 42.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

The invention claimed is:

1. An overfill prevention system for use in pumping fluid from one large tank to another comprising:

a signal probe located in a second tank; and a power take off switch assembly comprising a pneumatic switch that controls a pneumatically-operated power take off driving a pump controlling the flow of fuel from a first tank to said second tank;

wherein an electrical signal is sent from the signal probe to the pneumatic switch in the power take off switch assembly which flips the switch and ceases operation of the pump when the fuel in the second tank contacts the signal probe, and further wherein, the system comprises a dummy plug to allow manual override by an operator to restart operation of the pump while the fuel in the second tank is contacting the signal probe.

2. The overfill prevention system of claim 1 further comprising a secondary overfill prevention device which receives the signal from the signal probe and is electronically connected to the power take off switch assembly.

3. The overfill prevention system of claim 2 further comprising a fuel shut off sensor assembly connected electronically between the secondary overfill prevention device and the power take off switch assembly.

4. The overfill prevention system of claim 1 wherein the power take off switch assembly further comprises a toggle switch.

5. The overfill prevention system of claim 1 wherein the power take off switch assembly further comprises an indicator light.

* * * * *